United States Patent [19]

Brodeur

[11] 3,934,447

[45] Jan. 27, 1976

[54] VERTICAL ROLL CHANGING APPARATUS

[75] Inventor: Robert R. Brodeur, Worcester, Mass.

[73] Assignee: Morgan Construction Company, Worcester, Mass.

[22] Filed: Jan. 10, 1975

[21] Appl. No.: 540,157

[52] U.S. Cl. ..... 72/239; 294/81 R

[51] Int. Cl.[2] ..... B21B 31/08

[58] Field of Search ..... 72/239, 238; 294/81 R, 294/81 SF

[56] References Cited

UNITED STATES PATENTS

| | | | |
|---|---|---|---|
| 2,583,844 | 1/1952 | Hill et al. | 72/239 |
| 3,339,966 | 9/1967 | Carlson | 294/81 R |
| 3,425,256 | 2/1969 | McGoogan et al. | 72/239 |
| 3,583,196 | 6/1971 | Qualey | 72/239 |

*Primary Examiner*—Milton S. Mehr

*Attorney, Agent, or Firm*—Thompson, Birch, Gauthier & Samuels

[57] ABSTRACT

An apparatus is disclosed for moving an assembly of two vertical rolls and their respective upper and lower bearing chocks into and out of a roll housing in a rolling mill. The apparatus includes a central carrying member acting through oppositely extending adjustable link members pivotally connected to the upper bearing chocks of the roll assembly.

5 Claims, 4 Drawing Figures

VERTICAL ROLL CHANGING APPARATUS

BACKGROUND OF THE INVENTION

This invention relates generally to rolling mills, and is concerned in particular with an improved means for moving the combination of two vertical rolls and their respective upper and lower bearing chocks into and out of a roll housing.

In a rolling mill, periodic roll changes are required when the roll grooves become worn. In the past, various devices have been developed to assist operating personnel in making these changes, but for a variety of reasons, these devices have not proven entirely satisfactory. For example, none of the known prior art devices is capable of remaining attached to the bearing chocks during the rolling operation. Thus, valuable production time is lost during each roll change due to the fact that these roll changing devices must first be attached to the bearing chocks of the worn rolls prior to removing them from the housing, and further due to the fact that thereafter, these devices must be removed from the bearing chocks of the replacement rolls following their insertion into the roll housing. Mill down time is further lengthened in some cases because some of the prior art roll changing devices only operate on single rolls, thus doubling the time required to change each roll pair. Another drawback with many known roll changing devices lies in the fact that they are incapable of maintaining the work rolls in proper horizontal and vertical alignment during transfer from one location to another. This complicates the job of maintenance personnel, particularly at the stage when the replacement rolls are being inserted into the housing. With certain of the known roll changing devices, it is also possible for the roll cylinders to become damaged by banging against one another during transist to and from the roll housing. Still another known roll changing devices are not adjustable to accommodate different-sized rolls.

One object of the present invention is the provision of an improved roll changing device which can be employed to handle simultaneously two vertical rolls and their respective upper and lower bearing chocks, and which can remain attached to the upper bearing chocks during operation of the mill. This makes possible significant reductions in mill down time.

Another object of the present invention is the provision of a roll changing device which is readily adjustable to accommodate different-sized rolls.

Still another object of the present invention is the provision of a roll changing device which has the capability of maintaining the work rolls in proper horizontal and vertical alignment during transit, and of preventing the roll cylinders from coming into damaging contact with each other.

SUMMARY OF THE INVENTION

According to the present invention, there is provided a lifting assembly which includes a central carrying member having a vertical axis along which are spaced two transversely extending pins. The uppermost of these pins provides a pivotal connection for oppositely extending overlapping link members which are in turn pivotally connected to the upper bearing chocks of the vertical rolls. The link members are provided with arcuate slots to receive the uppermost pin. These slots permit the link members to be adjusted to accommodate different-sized rolls. The link members are further provided with oppositely inclined surfaces which are engaged by the lowermost of the aforesaid pins when an upward force is exerted on the carrying member during a lifting operation. The inclination of these surfaces is such that when the roll assembly is lifted, the upward force on the carrying member is resolved into horizontal and vertical force components. The vertical force components lift the rolls and their respective chocks, while the horizontal force components maintain the rolls and their respective chocks properly separated and aligned.

BRIEF DESCRIPTION OF THE DRAWINGS

An embodiment of the invention will now be described by way of example only, with reference to the accompanying drawings, wherein.

DESCRIPTION OF PREFERRED EMBODIMENT

Figure 1:
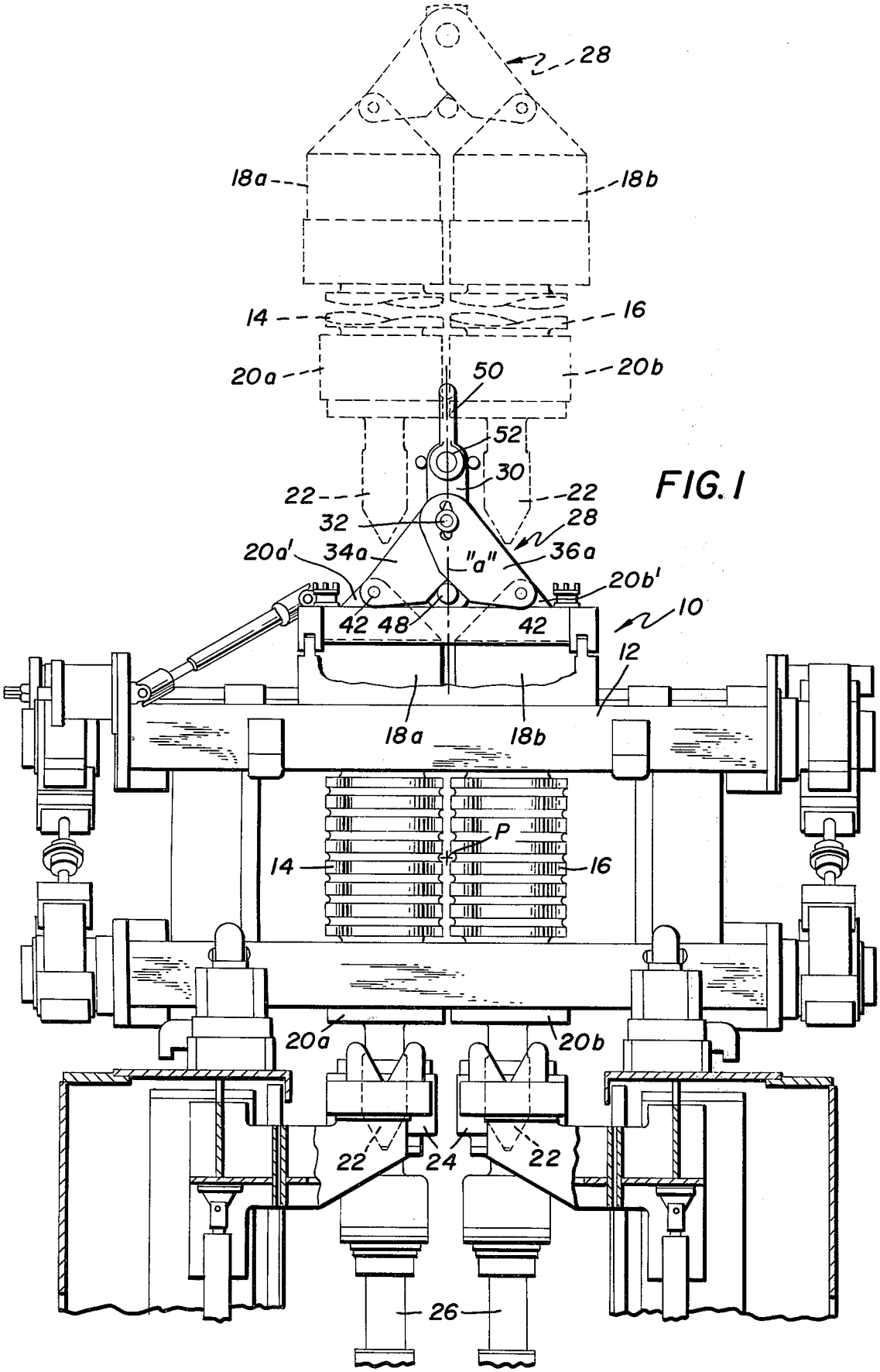
FIG. 1 is a front elevational view of a typical vertical roll stand in a rolling mill, and having associated therewith a preferred embodiment of a roll changing device of the present invention.
Figure 2:
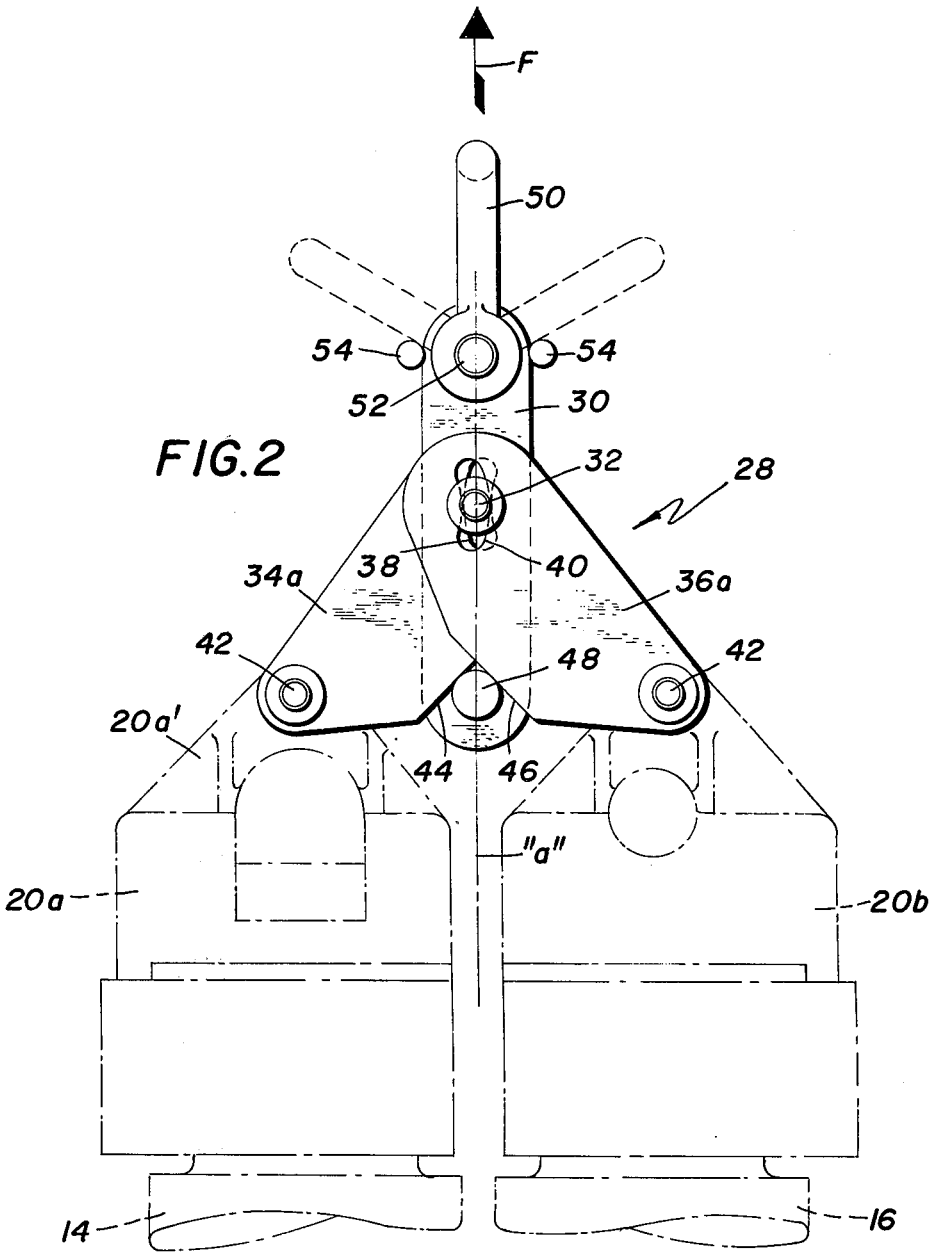
FIG. 2 is an enlarged front elevational view of the roll changing device.
Figure 3:
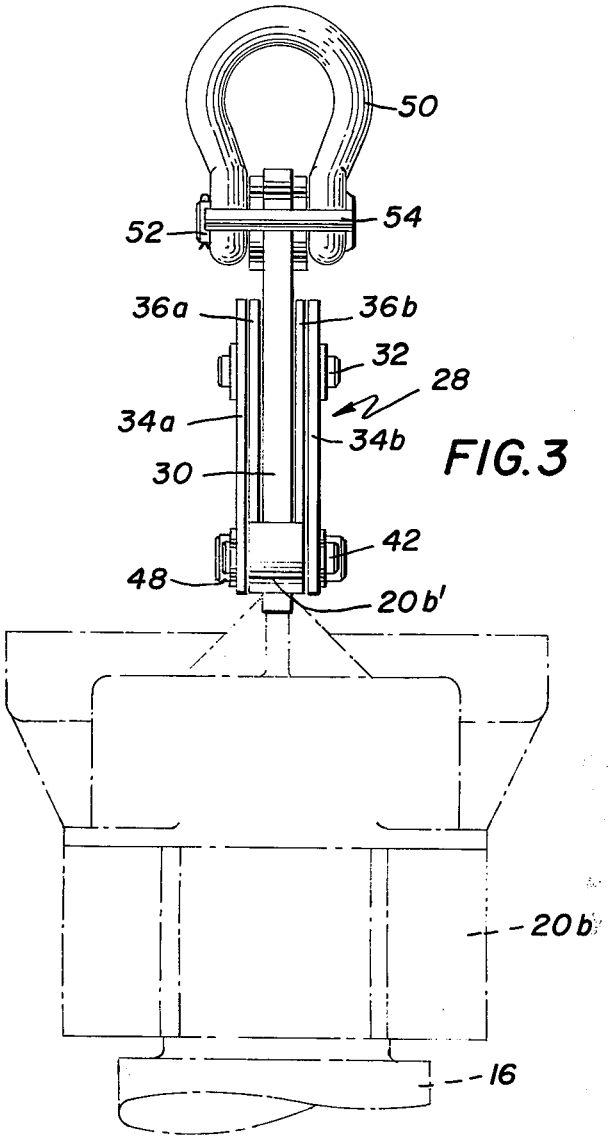
FIG. 3 is a side elevational view of the roll changing device.

Referring now to the drawings, there is generally depicted at 10 a typical vertical roll stand having a roll housing 12 containing a pair of grooved parallel vertical rolls 14 and 16. The roll necks of roll 14 are journalled respectively in upper and lower bearing chocks 18*a*, 20*a*, and likewise the roll necks of the roll 16 are journalled for rotation in upper and lower bearing chocks 18*b*, 20*b*. Each roll is driven from beneath the housing by means of a depending extension 22 which is axially received in a collar 24 on a drive spindle 26.

It will be understood that during a rolling operation, the upper and lower bearing chocks 18, 20 are retained in the housing 12 by conventional means including laterally adjustable rails and clamps (not shown). When the roll grooves become worn, thus necessitating a roll change, the chock clamps are released, thus freeing the rolls and their respective bearing for removal from the housing. This is accomplished through use of a roll changing device in accordance with the present invention, a preferred embodiment of which is generally indicated by the reference numeral 28.

The roll changing device 28 includes a preferably elongated and vertically arranged carrying member 30 having a longitudinal axis which is depicted by a reference line "*a*" perpendicular to the mill center line "P". A first pin 32 extends transversally through the carrying member 30 on reference line "*a*". Pin 32 provides the means at a common central location for connecting overlapping pairs of first and second links 34*a*, 34*b* and 36*a*, 36*b* to the carrying member 30. Extension of pin 32 through the links 34*a*, 34*b* is acommodated by arcuate slots 38 curving in one direction, and through links 36*a*, 36*b* by arcuate slots 40 curving in the opposite direction. The upper portions of the links 34*a*, 36*a* and their respective arcuate slots 38, 40 overlap each other on one side of the carrying member 30, and the same relationship exists on the opposite side of the carrying member as regards the links 34*b*, 36*b*.

The links 34*a*, 34*b* are pivotally connected to an upstanding ear 20*a'* on upper bearing chock 20*a* by a second pin means 42. Likewise, the links 36*a*, *36b* are pivotally connected to an upstanding ear 20*b*′ on upper bearing chock 20*b* by second pin means 42.

The links 34*a*, 34*b* are each provided with contact surfaces 44 inclined in one direction with respect to reference line "*a*", while the links 36*a*, 36*b* are provided with like but oppositely inclined contact surfaces 46. The contact surfaces 44, 46 are arranged for engagement with a third pin means 48 on the carrying member 30. The third pin means 48 is located on reference line "*a*" and is spaced vertically below first pin means 32.

A lifting eye 50 is pivotally connected to the upper end of the carrier member 30 by a fourth pin means 52 which is also located on reference line "*a*" at a location spaced vertically above the first pin means 32. A pair of eye supports 54 may if desired be welded to opposite edges of the carrying member 30 to limit the extent to which the lifting eye 50 may pivot downwardly in either direction about pin 52.

In light of the foregoing, it will now be understood that the carrying member 30, the links 34*a*, 34*b*, 36*a*, 36*b*, the lifting eye 50, and the pins 32, 48 and 52 are assembled as an integral carrying device or assembly which may be connected to the upper bearing chocks of any particular pair of work rolls. The carrying device will remain thus connected during the rolling operation. The arcuate slots 38, 40 will provide a range of adjustability which will permit the device to be employed with different diameter rolls. In other words, for larger diameter rolls, the distance between the pivotal connections established by the pins 42 will necessarily be greater, causing the pin 32 to be located in the upper regions of the arcuate slots 38, 40, and causing the pin 48 to engage the upper regions of the inclined surfaces 44, 46. With smaller diameter rolls, the reverse will be true.

Figure 4:
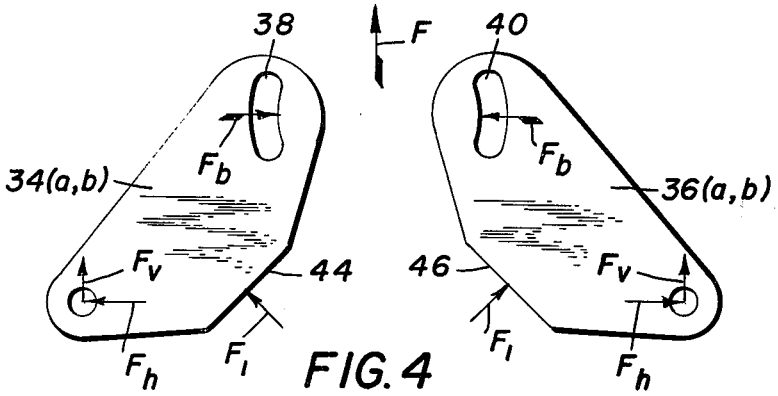
FIG. 4 is a front elevation of the link members.

During a lifting operation, when the rolls are being transported into or out of the housing, the hook of an overhead crane (not shown) or other like apparatus will engage lifting eye 50 and exert an upward force "F" on the carrying member 30 along axis "*a*". As indicated diagrammatically in FIG. 4, Force "$F_1$" will be transmitted at "F" by pins 48 against the inclined surfaces 44, 46 of the links 34*a*, 34*b* and 36*a*, 36*b*. Each force $F_1$ may be resolved into horizontal and vertical force components $F_h$ & $F_v$ at each of the pins 42 which connect the links to the upper bearing chocks. The vertical force components $F_v$ which are coincident with the roll axes will lift the rolls and their respective upper and lower bearing chocks, while the horizontal force components $F_h$ will serve to maintain the rolls and their respective chocks separated form each other. The pin 32 will exert opposite horizontal balancing forces $F_b$ on the links at the arcuate slots 38, 40, thereby maintaining the device in a balanced and stable condition. As the rolls and chocks are lifted, the carrying member 30 and its links 34, 36 will remain fixed in relation to each other, thereby maintaining the desired horizontal and vertical alignment of the rolls. In this manner, a worn set of rolls and their respective chocks can be removed from the housing and carried to the roll shop, and a replacement set of rolls and chocks with a duplicate carrying device already attached thereto can be returned by the same crane and reinserted into the housing. The roll changing device of the present invention permits this to be accomplished in a more rapid and efficient manner than would otherwise be possible with devices heretofore available.

It is my intention to cover all changes and modifications to the embodiment herein chosen for purposes of disclosure which do not depart from the spirit and scope of my invention.

I claim:

1. In a rolling mill having a housing containing a roll assembly which includes a pair of vertical rolls with the upper and lower roll necks of each roll journalled respectively in upper and lower laterally spaced bearing chocks, a carrying assembly for use in vertically moving the said roll assembly into and out of the said housing said carrying assembly comprising: a carrying member and first and second link members; first pin means for connecting said first and second link members to said carrying member at a common central location; second pin means for pivotally connecting said first and second link members to the upper bearing chocks of the roll assembly; and, third pin means on said carrying member at a lower central location spaced beneath said first pin means, said third pin means being engageable with oppositely inclined surfaces on said first and second link members.

2. The apparatus as claimed in claim 1 wherein said first and second link members are provided respectively with oppositely curving arcuate slots which are arranged in an overlapping relationship at said common central location to accommodate extension therethrough of said first pin means.

3. The apparatus as claimed in claim 1 wherein pairs of said first and second link members are employed with said carrying member, with one link member of a pair overlapping another link member of the other pair on opposite sides of said carrying member, and with each pair being connected respectively to one of the upper bearing chocks of the roll assembly by said second pin means.

4. The apparatus as claimed in claim 1 further characterized by a lifting eye connected by fourth pin means to said carrying member at a location along said reference line spaced vertically above said first pin means.

5. For use in moving a vertical roll assembly into and out of a roll housing, the said roll assembly including a pair of parallel vertical rolls with the upper and lower roll necks journalled for rotation in upper and lower bearing chocks, a carrying assembly comprising in combination: a carrying member having a vertically extending axis with vertically spaced upper and lower pin means extending transversally in relation thereto, oppositely extending link members connected to said carrying member by said upper pin means, other pin means for pivotally connecting said link members to the upper bearing chocks of the roll assembly, and oppositely inclined faces on said link members, said faces being engageable with said lower pin means, the inclination of said faces relative to said axis being such that a lifting force exerted on said carrying member along said axis will be resolved at each of said other pin means into vertical force components coincident with the roll axes and horizontal force components maintaining said rolls and their respective upper and lower bearing chocks in a laterally spaced relationship.

* * * * *